United States Patent [19]

Medlock

[11] Patent Number: 4,823,561

[45] Date of Patent: Apr. 25, 1989

[54] REFRIGERATION APPARATUS HAVING A HEAT EXCHANGER PRE-COOLING ELEMENT

[76] Inventor: Danny H. Medlock, 5008 W. Linebaugh Ave., Ste. 24, Tampa, Fla. 33 624

[21] Appl. No.: 169,840

[22] Filed: Mar. 18, 1988

[51] Int. Cl.[4] ..... F25B 41/00

[52] U.S. Cl. ..... 62/513; 165/108; 62/515

[58] Field of Search ..... 165/108; 62/113, 513, 62/515

[56] References Cited

U.S. PATENT DOCUMENTS 4,357,805 11/1982 Manning ..... 62/117

4,577,468 3/1986 Nunn, Jr. et al. ..... 62/513

*Primary Examiner*—Ronald C. Capossela

*Attorney, Agent, or Firm*—Herbert W. Larson

[57] ABSTRACT

In a standard refrigeration system employing in series a compressor, condenser, heat exchanger and evaporator, the cooling efficiency of the heat exchanger has been improved by routing a portion of the refrigerant in a flashed state through multiple cooling cells within the heat exchanger. The main refrigerant supply is fed through the heat exchanger in a serpentine fashion juxtaposed to the cooling cells so that the refrigerant exiting from the heat exchanger and delivered to the evaporator is at the lowest practical temperature. Separate water and oil lines are fed around the cooling cells to reduce their temperature for use in making ice and cooling the compressor respectively.

7 Claims, 3 Drawing Sheets

REFRIGERATION APPARATUS HAVING A HEAT EXCHANGER PRE-COOLING ELEMENT

BACKGROUND OF THE INVENTION

1. Field of the invention

This invention relates to refrigeration systems. More specifically it refers to a refrigeration apparatus having a heat exchanger with a pre-cooling element.

2. Description of the Prior Art

An important consideration in the conservation of energy in a refrigeration system is the delivery of the refrigerant to the evaporator coil at the lowest temperature possible. Such low temperature lowers the volumetric refrigerant circulation requirement in the system. U.S. Pat. No. 4,577,468 includes a description of a pre-cooler heat exchanger wherein vaporized refrigerant is used for cooling in the heat exchanger by being passed in a small conduit through a larger conduit containing liquid refrigerant. Evaporation of the refrigerant in the smallest conduit cools the liquid refrigerant in the larger conduit. U.S. Pat. No. 4,357,805 teaches a large chambered flash sub-cooler with a liguid refrigerant line running through the chamber. The latent heat of evaporation is used to cool the nearby liquid refrigerant. The actual evaporation takes place in the flash chamber surrounding the refrigerant feed line. In still another, U.S. Pat. No. 2,388,556, a liguid refrigerant is cooled by gaseous refrigerant flowing from an outlet end of the evaporator to the condenser. Although all of these Patents teach methods and systems increasing the efficiency of a refrigeration system, there is room for improvement to still further increase the efficiency of the refrigeration system and thereby conserve fuel. A system for increasing efficiency of those refrigeration systems presently in existence is continuously a sought after goal.

SUMMARY OF THE INVENTION

I have designed a refrigeration system which significantly increases the efficiency of heretofore existing refrigeration systems. My system employs a compressor, conduits from the compressor to a condenser and a conduit from the condenser to a heat exchanger. Part of the outflow from the heat exchanger goes to the main suction and the remainder to the evaporator. From the evaporator the refrigerant flows through conduits to the suction line accumulator and then back to the compressor for continued flow through the system in the same manner as described above. My invention resides in the design of the heat exchanger and the input and output lines to and from this unit. In my device, the heat exchanger receives the refrigerant such as FREON at one end. The liquid refrigerant flows in a serpentine pattern from the bottom to the top of the heat exchanger. During the passage a small amount of the refrigerant liquid is bled off into a separate line wherein the refrigerant is vaporized and then passed through a series of cooling cells around which the liquid refrigerant is passing. At the same time, water is pumped from a pump source through a series of tubes winding around the various cooling cells to decrease the temperature of the water. The water is then pumped from the heat exchanger directly to an ice making system. Also, oil used in the compressor is pumped to a separate tube winding around the cooling cells in the heat exchanger. The oil is cooled down as it passes over the cooling cells and is pumped back to the compressor for reuse. The vaporized refrigerant passes out of the heat exchanger through a series of small tubes to the suction line accumulator. In this manner, oil for the refrigeration system, water for an ice making system and the refrigerant itself is reduced in temperature sufficiently so that all of the oil, water and refrigerant can be used more efficiently at lower temperatures.

BRIEF DESCRIPTION OF THE DRAWINGS

The invention may be best understood by those having ordinary skill in the art by reference to the detailed description when considered in conjunction with the accompanying drawings in which.

DETAILED DESCRIPTION OF THE INVENTION

Figure 1:
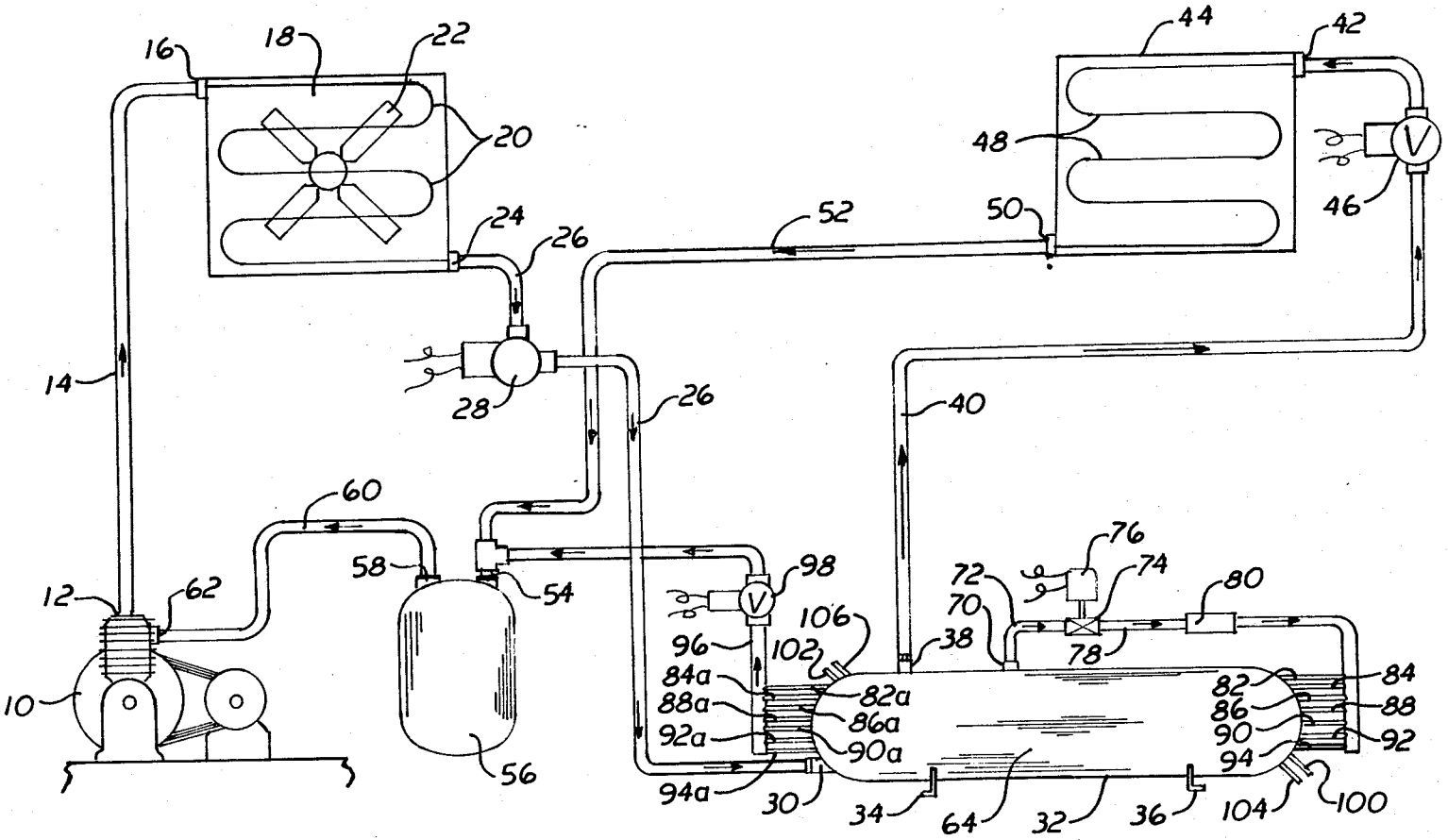
FIG. 1 is a schematic view of a preferred embodiment of this invention having an energy efficient refrigeration system with a pre-cooling heat exchanger.
Figure 2:
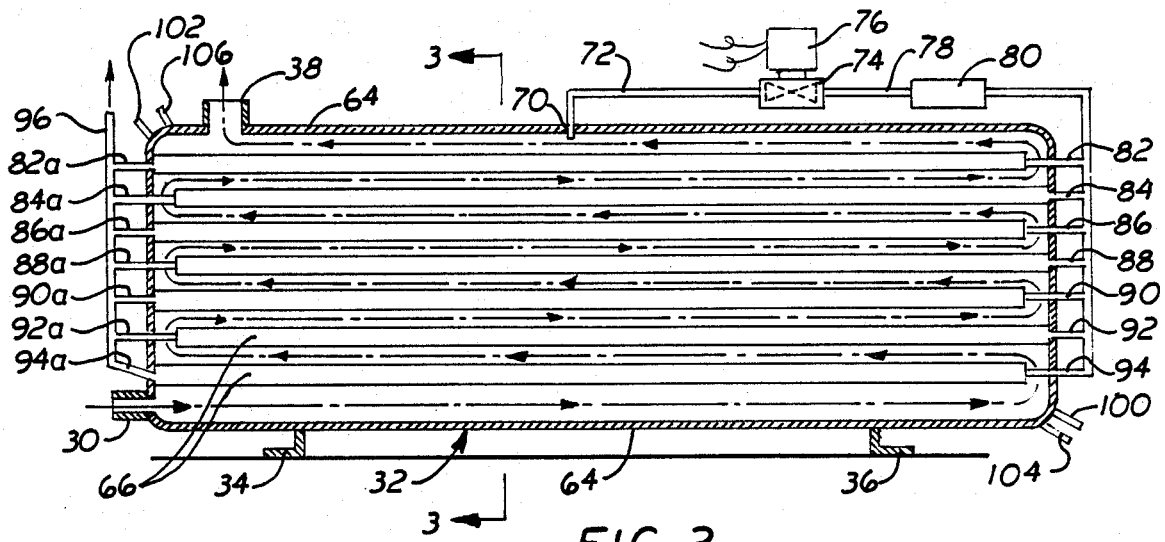
FIG. 2 is a longitudinal sectional view of the heat exchanger used in the refrigeration system.

Throughout the following detailed description, the same reference numerals refer to the same elements in all figures.

Referring to FIG. 1 the compressor 10 increases the temperature and pressure of the refrigerant which exits at outlet 12 and moves through conduit 14 to the inlet 16 to the condenser 18. The refrigerant moves through the condenser coils 20 and is cooled by fan 22. As an option, the fan may be deleted and the coils can be cooled by a water jacket. The hot liquid condensed refrigerant exits from condenser 18 through outlet 24 and continues along conduit 26 through a control valve 28 to the inlet 30 to the heat exchanger 32. Support brackets 34 and 36 maintain the position of the heat exchanger. After moving through the heat exchanger 32 the refrigerant fluid exits at outlet 38 from the heat exchanger and proceeds along conduit 40 to the inlet 42 for the evaporator 44. The refrigerant passes through metering valve device 46 prior to entering the inlet 42 to the evaporator 44. The metering device lowers the refrigerant pressure.

The refrigerant moves through the evaporator coil 48 and exits from the evaporator through outlet 50 and thereafter moves along conduit 52 to the suction line accumulator inlet 54. The accumulator 56 discharges the refrigerant through outlet 58. The refrigerant then moves through conduit 60 back to the inlet 62 in the compressor 10.

The heat exchanger 32 has an outer wall 64 encasing a series of multiple cooling cells 66. The refrigerant liguid entering at entrance 30 passes through channels 68 in a serpentine fashion moving in and out over the cooling cells 66 until the refrigerant exits at outlet 38 in order to flow to the evaporator.

A small amount of refrigerant is diverted at outlet 70 from the heat exchanger 32. This diverted refrigerant moves through small conduit 72, through shutoff valve 74 which is engaged to a magnetic coil or solenoid 76. At this point the pressure on the refrigerant is about 120–300 lbs. per square inch. The refrigerant then moves through conduit 78 to metering device 80 where the pressure drops after moving through the metering valve to 10–80 lbs. per square inch. Separate metering devices 80 can be used for each channel 82, 84, 86, 88, 90, 92 and 94. The refrigerant in a flashed or vaporized state passes through channels 82, 84, 86, 88, 90,92 and 94 in order to move through multiple cooling cells 66. The vaporized refrigerant moving through conduits 82, 84, 86, 88, 90, 92 and 94 cools down the respective cooling cells 66 which in turn cool down the liquid refrigerant passing through channels 68. The vaporized refrigerant passing through cooling cells 66 exit at even numbered conduits 82*a* through 94*a* and is then collected and delivered from manifold 96 to main suction 56 through valve 98.

The heat exchanger 32 has a series of fins 108 in the channels 68 to slow down the flow and assist in the cooling of the refrigerant.

Figure 3:
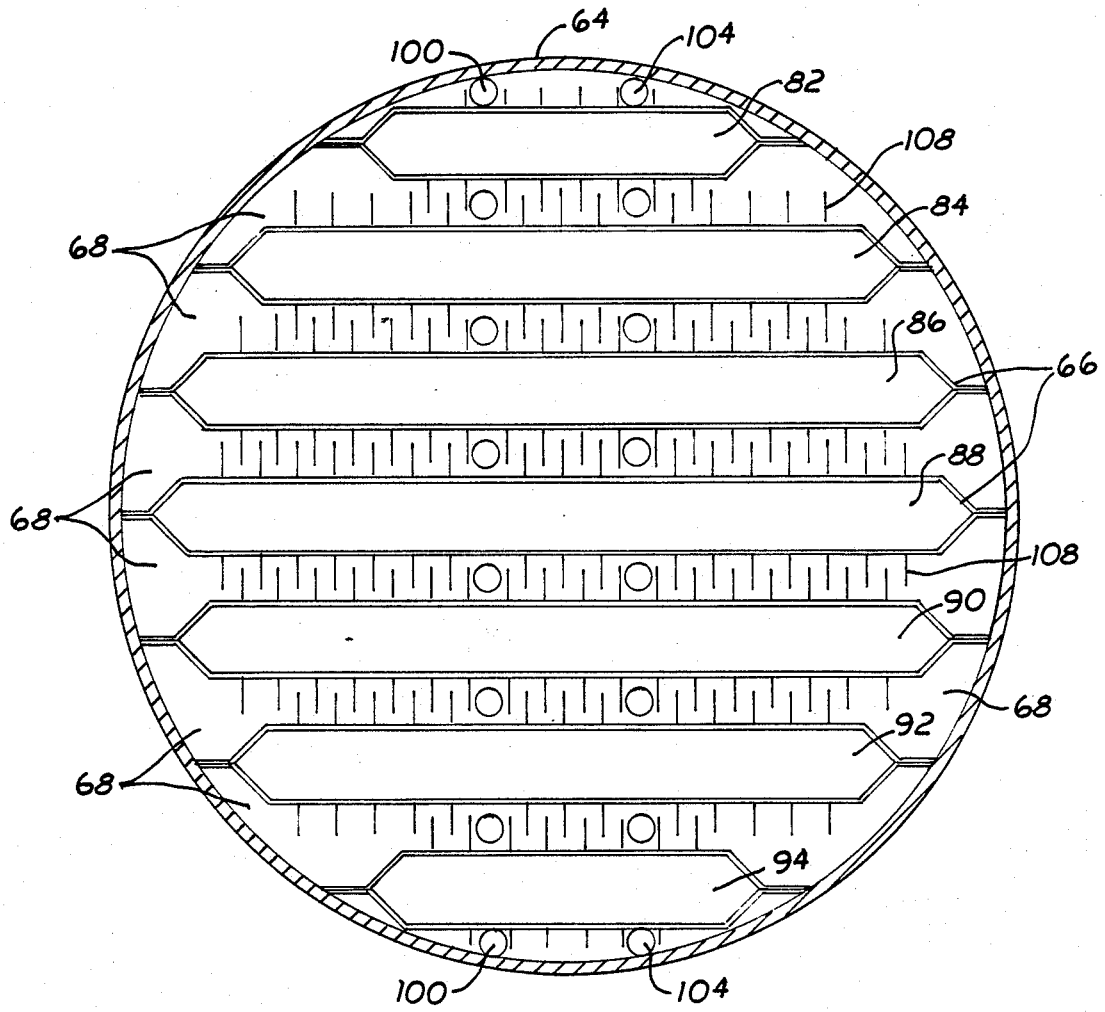
FIG. 3 is a cross-sectional view of the heat exchanger of FIG. 2 along lines 3—3.
Figure 4:
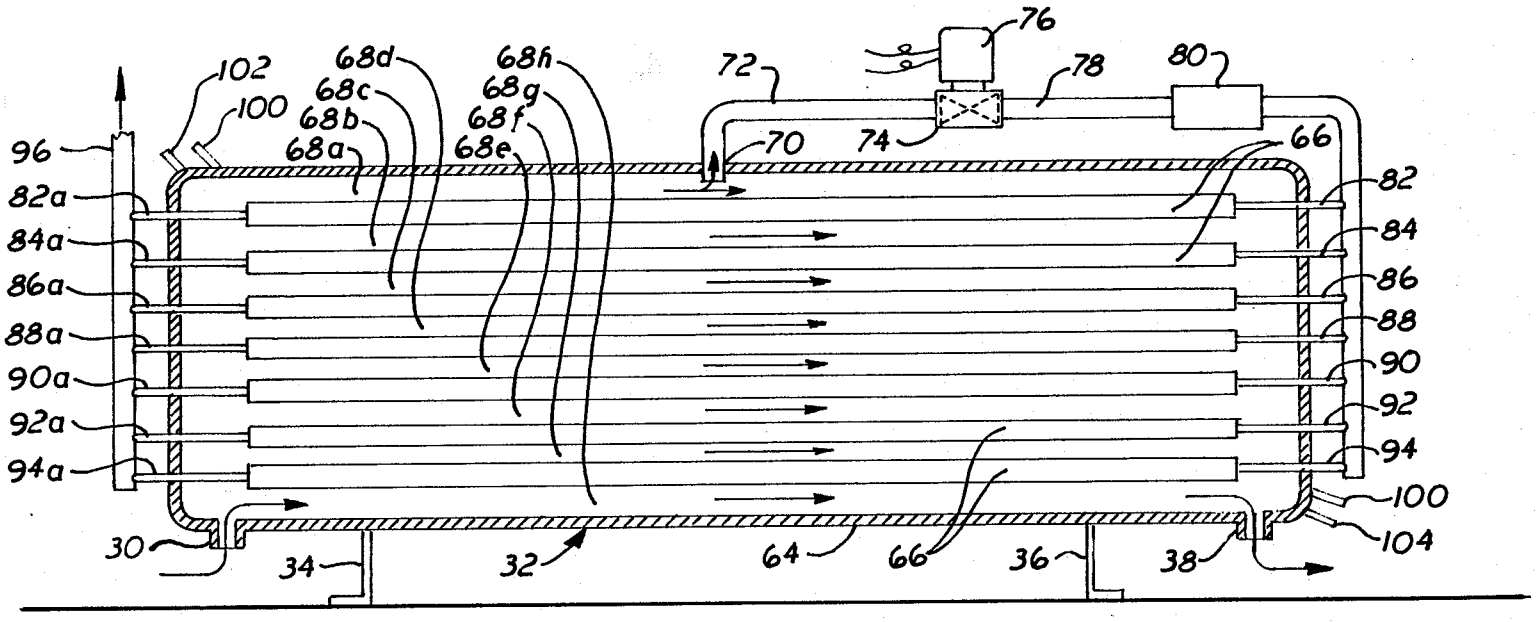

Optionally, a water line 100 can be wound through the heat exchanger 32 over and under the various cooling cells 66 as shown in FIG. 3 and then through outlet 102 for delivery to an ice making apparatus. The water line 100 also could be run through cooling cells 66. In this manner, the water used in the ice making apparatus has a lower temperature than the tap water and less energy is used in the normal operation of the ice making machinery. A second auxiliary conduit 104 carries oil from the compressor 10 through the heat exchanger 32 in a parallel line to the water line 100. Again, the conduit 104 containing the oil moves in and out through the cooling cells 66 and exits at 106 and then returns through an auxiliary conduit to the compressor 10. In this manner, the oil used with the compressor does not require a separate cooling unit.

The heat exchanger 32 has a jacket or outer wall 64 made of steel or copper. The cooling cells 66 and fins 108 are preferably made of copper but can be made of steel. It is preferred that the various conduits are made from steel. The compressor 10 can vary in horsepower from one-half to 2000, depending upon the size of the refrigeration system desired. Regardless of the size of the system, the present invention will diminish the strain on the compressor and extend its life. The use of conduits 100 and 104 containing oil or water respectively is optional with this invention, but its use particularly in a refrigeration system used for making ice, is substantially more efficient than feeding water directly from a tap into the ice making refrigeration system or requiring additional oil cooling means for a compressor.

Equivalent elements can be substituted for the various components of the refrigeration system set forth above without departing from its scope.

Having thus having described the invention, what is claimed and desired to be secured by Letters Patent is:

1. In a refrigeration system including a compressor, a condenser, a heat exchanger and an evaporator all connected in series, the improvement comprising an elongated heat exchanger having an outer wall enclosing:

a multiplicity of longitudinally extending cooling cells each enclosing a first channel containing vaporized refrigerant;

a second channel from an entrance to the heat exchanger, and directed in a serpentine fashion throughout the heat exchanger juxtaposed to the cooling cells and exiting through a first outlet through the outer wall connected to a conduit which is connected to the evaporator;

the second channel having a second outlet through the outer wall to a conduit outside the heat exchanger leading to a solenoid operated valve;

a conduit from the solenoid operated valve to a metering valve device which lowers the refrigerant pressure and causes it to vaporize;

a conduit from the metering valve device to the first channel enclosed by the cooling cell whereby the vaporized refrigerant acts to cool the cooling cells and in so doing also cools the refrigerant passing through the second channel within the heat exchanger; and the heat exchanger connected to the condenser by a conduit through which hot liquid condensed refrigerant is fed to the entrance to the heat exchanger.

2. In the refrigeration system according to claim 1 a water conduit passing through the outer wall of the heat exchanger and winding over and under the cooling cells and exiting at a distal point from its entrance through the wall of the heat exchanger and continuing to an ice making apparatus.

3. In a refrigeration system according to claim 1, an oil conduit passing from the compressor through the outer wall of the heat exchanger, winding over and under the cooling cells, exiting at a distal point from its entrance through the wall of the heat exchanger and continuing back to the compressor.

4. In a refrigeration system according to claim 1 wherein a multiplicity of fins are mounted within the second channel of the heat exchanger to slow the flow of refrigerant.

5. A heat exchanger for use in a refrigeration system comprising:

an elongated metal jacket enclosed with an outer wall;

a multiplicity of longitudinally extending cooling cells mounted within the jacket;

a first channel within each cooling cell containing vaporized refrigerant;

a second channel configured in a serpentine path from an inlet through the outer wall to an exit through the outer wall distill from its inlet, the second channel being juxtaposed to the cooling cells and containing liquid refrigerant; and a metering device mounted external to the jacket to receive liquid refrigerant from the second channel and vaporize it for delivery to the first channel.

6. A heat exchanger according to claim 5 wherein an oil containing conduit penetrates the outer wall, winds around the cooling cells and exits at a point distal from its entry.

7. A heat exchanger according to claim 5 wherein a water containing conduit penetrates the outer wall, winds around the cooling cells and exits at a point distal from its entry.

* * * * *